US007107981B1

(12) United States Patent
Dunn

(10) Patent No.: US 7,107,981 B1
(45) Date of Patent: Sep. 19, 2006

(54) DEVICE FOR SECURING A COMPRESSED GAS SYSTEM TO A PAINTBALL GUN

(76) Inventor: Jason Forrest Dunn, 1642 Kodiak Dr., Colorado Springs, CO (US) 80910

( * ) Notice: Subject to any disclaimer, the term of this patent is extended or adjusted under 35 U.S.C. 154(b) by 96 days.

(21) Appl. No.: 10/865,571

(22) Filed: Jun. 10, 2004

Related U.S. Application Data

(60) Provisional application No. 60/477,835, filed on Jun. 11, 2003.

(51) Int. Cl.
*F41B 11/32* (2006.01)

(52) U.S. Cl. ..... 124/80; 124/74

(58) Field of Classification Search ..... 124/71–75; D21/572–575
See application file for complete search history.

(56) References Cited

U.S. PATENT DOCUMENTS

D337,627 S * 7/1993 Moran ..... D21/572
5,704,342 A * 1/1998 Gibson et al. ..... 124/73
5,778,868 A * 7/1998 Shepherd ..... 124/76
5,927,261 A * 7/1999 Bofill ..... 124/80
5,950,611 A * 9/1999 Lopez et al. ..... 124/72
D430,257 S * 8/2000 Chang ..... D22/108
6,142,137 A * 11/2000 MacLaughlin ..... 124/72
6,311,683 B1 * 11/2001 Lee ..... 124/71
D451,977 S * 12/2001 Urbano ..... D21/572
D482,081 S * 11/2003 Chang ..... D21/573
D482,082 S * 11/2003 Chang ..... D21/573
D482,414 S * 11/2003 Carpenter ..... D21/573
D482,743 S * 11/2003 Chang ..... D21/573
6,675,791 B1 * 1/2004 Alexander et al. ..... 124/71
6,732,726 B1 * 5/2004 Ho ..... 124/74
6,739,323 B1 * 5/2004 Tippmann, Jr. ..... 124/51.1
6,935,324 B1 * 8/2005 Watson et al. ..... 124/49
6,941,938 B1 * 9/2005 D'Arcy et al. ..... 124/76
D512,751 S * 12/2005 Malmloff ..... D21/573
2001/0050076 A1 * 12/2001 Colby ..... 124/74
2002/0046747 A1 * 4/2002 Colby ..... 124/73
2003/0024519 A1 * 2/2003 Chen ..... 124/72
2003/0226555 A1 * 12/2003 Reible ..... 124/73
2004/0040552 A1 * 3/2004 Ho ..... 124/74
2004/0107951 A1 * 6/2004 D'Arcy et al. ..... 124/74
2005/0005924 A1 * 1/2005 Sheng ..... 124/74
2005/0091900 A1 * 5/2005 Tippmann, Jr. ..... 42/76.01

* cited by examiner

*Primary Examiner*—Troy Chambers

(57) ABSTRACT

The present invention is a mounting bracket used to attach a compressed gas system to a lower side surface of a paintball gun. The mounting bracket positions the compressed gas system in relation to the paintball gun such that it lowers the vertical profile of the paintball gun system and shortens its overall length with respect to the user's body, and prevents the compressed gas system from obstructing the user's arm when grasping the paintball gun. The mounting bracket positions the tank such that a considerable portion of the paintball gun system's weight is borne by the user's shoulder, and makes the paintball gun system easier to stabilize while in motion or at rest.

10 Claims, 8 Drawing Sheets

DEVICE FOR SECURING A COMPRESSED GAS SYSTEM TO A PAINTBALL GUN

CROSS-REFERENCE TO RELATED APPLICATIONS

This application claims the benefit of PPA Ser. No. 60/477,835, filed 2003 Jun. 11 by the present inventor.

FEDERALLY SPONSORED RESEARCH

Not Applicable

SEQUENCE LISTING OR PROGRAM

Not Applicable

BACKGROUND OF THE INVENTION

1. Field of the Invention

The present invention relates to a device for securing a compressed gas system to a paintball gun of the type that uses a compressed gas cylinder to propel paintballs from the paintball gun. In particular, this device positions the compressed gas cylinder, at an angle, on the shoulder of the user to lower the vertical profile of the paintball gun, shorten the paintball gun's effective length, reduce the effective weight of the paintball gun on the user's arms, and prevent the compressed gas cylinder from obstructing the user's hands, wrists and/or arms while grasping or manipulating the paintball gun.

A paintball gun, paintball loader, compressed gas system, the present invention, and any other item attached to the aforementioned elements during the course of normal operation comprise a "paintball gun system" and will be referred to as such in this specification.

2. Description of the Related Art

Several different structures have been developed for the purpose of mounting a compressed gas system to a paintball gun. When the paintball industry began promoting the benefits of compressed air over carbon dioxide as the ideal propellant, (namely, greater shot-to-shot consistency and superior cold weather performance), the issue of conveniently and ergonomically mounting a compressed gas system to a paintball gun became a more difficult task. In general, carbon dioxide cylinders are 2 to 3 inches in diameter, and are cumbersome yet manageable obstacles as regards the grasping, aiming, and firing of a paintball gun. Compressed air cylinders however, range from 4 to 5 inches in diameter, and make the paintball gun much more awkward to manipulate. There are 3 basic methods/devices (in the public domain) for attaching a compressed air system to a paintball gun, which were all developed successively to account for particular shortcomings in the previous designs, but each of these designs introduced other undesirable elements that adversely affected the ergonomics of the paintball gun system. There are other, related examples of prior art contained in the U.S. Pat. Nos. 5,950,611, 5,927,261, 6,732,726, that have also attempted to overcome some of the shortcomings of those aforementioned products within the public domain.

The first paintball guns used small, disposable, 12-gram carbon dioxide cartridges. These cartridges were capable of providing the necessary propellant for 10–20 paintballs before depletion. These first paintball guns used a "pump action" in that the gun would require a manual re-cocking after each firing cycle. The rates of fire on these paintball guns were rather slow, and they typically used 10-round magazines. As the sport progressed, so did the state of the art of paintball equipment. Larger magazines and larger compressed gas sources were developed that allowed the paintball player to shoot more paintballs, faster, before requiring a re-load of paintballs and a re-fill of the compressed gas cylinder. The first paintball guns to use the larger, refillable compressed gas systems (then known as "Constant Air", but which actually used carbon dioxide) typically attached the cylinder to the paintball gun by means of strapping to the forestock, rearstock or barrel. This was not an ideal configuration, and was used primarily as a retrofit to adapt the new technology of Constant Air to the existing, available paintball guns.

The next major innovation in this field involved the use of a male-threaded pin valve attached to the compressed gas cylinder, and a corresponding female-threaded fitting at the rear of the paintball gun called the Air Systems Adapter (ASA). This allowed the compressed gas cylinder to be screwed into the rear of the receiver of the gun so that the cylinder could also function as a gunstock. This was an effective means of stabilizing the paintball gun for aiming and firing purposes, but it placed the gun so far in front of the player that it was often exposed to returned fire. (In the game of paintball, if a player's paintball gun is hit by a paintball, then that player is typically eliminated from play.) This method of mounting a compressed gas system to a paintball gun is nearly obsolete and is rarely seen anymore. The next development was an intermediate step in the evolution of the compressed gas cylinder mounting apparatus. The female ASA element was moved from directly behind the paintball gun receiver to just below the bottom of the trigger frame of the paintball gun. This shortened the overall length of the gun by perhaps an inch, but it also raised the gun up by three or four inches. The ultimate result of this was that the paintball loader of the paintball gun, which is generally attached to the top of the paintball gun via a feed tube, was exposed well above the player's head, which made it an easy target. Shortly after this development, a device known as the "drop forward" was created. This was a mounting bracket that further lowered the compressed gas system and moved it forward. This noticeably shortened the length of the gun, but if the gun were still to be shouldered in the traditional sense, it would place the hopper several inches above the player's head. As a result, many players began to "shoulder" the paintball gun in their armpits, rib cages or stomachs to lower the effective height of the paintball gun system. This was uncomfortable, and made the paintball gun system difficult to stabilize.

U.S. Pat. No. 6,732,726 describes a paintball gun with a front mounted gas cylinder. This produces an effect very similar to what the "drop forward" accomplishes and, as expected, encounters the same problems. It also mentions other advantages not related to the present invention. U.S. Pat. No. 5,950,611 describes a paintball gun with a moveable compressed gas tank. This device mounts the gas tank to a rotating attachment member. When the device is in its nadir position, the device functions identically to a "drop forward." However, the device may be rotated such that the tank is placed laterally outward from the gun, in effect, removing the forearm obstruction and lowering the vertical profile of the gun. However, when switching the gun to the opposite hand, a reconfiguration of the device is required to achieve the same effect, else the forearm obstruction is amplified. Since paintball is a fast-paced game where mere seconds often mean the difference between winning or losing, a paintball player simply cannot afford to waste time reconfiguring his or her paintball gun each time he or she wishes to shoot from a different side of his or her body. U.S. Pat. No. 5,927,261 describes an adjustable gas cartridge mount that also laterally displaces the gas cylinder, with an effect similar to, but via a different method than U.S. Pat. No. 5,950,611. However, reorientation of the gas cylinder with this device is a cumbersome effort requiring tools to accomplish. The tank could not feasibly be reconfigured during a paintball game without violating a rule of most paintball games which states that tools are not allowed on the field during game play.

All of the aforementioned systems assume that the butt end of the compressed gas cylinder be abutted to the shoulder of the user, which has made the solution to the problem of how to ergonomically mount a large, awkward, propellant source to a paintball gun an elusive one. These systems also require the user to forcibly hold the butt-end of the compressed gas cylinder to the shoulder in the same manner one would use when firing a hunting rifle. This is difficult to do while running or walking since the various components of the human body do not move in unison with respect to each other when the body is in motion. This makes holding the compressed gas cylinder to the body while shooting and running (a valuable capability in the game of paintball) a difficult endeavor. Until now, each of these solutions has managed to solve certain aspects of the problem, but have also managed to introduce new or worsen other, existing aspects of the problem. The present invention offers a solution to all of these aspects.

3. Objects and Advantages

Accordingly, several objects and advantages of my invention are:

a) to provide a mounting bracket which allows for the compressed gas system of a paintball gun to be placed roughly on top of the user's shoulder, transferring a portion of the total weight of the paintball gun system to the user's shoulder and reducing the amount of weight borne by the user's arms;

b) to provide a mounting bracket which allows for the compressed gas system of a paintball gun to be placed roughly on top of the user's shoulder, so that the user may operate the gun while in motion without the compressed gas system slipping from its point of contact on the user's body;

c) to provide a mounting bracket which allows for the compressed gas system of a paintball to be tilted in such a way that it allows for the approximate center of the compressed gas cylinder to rest on the user's shoulder, thereby reducing the effective length of the paintball gun system;

d) to provide a mounting bracket which allows for the compressed gas system of a paintball to be positioned in such a way that the compressed gas system does not obstruct the hands, wrists, or arms of the user, and that does not require a reconfiguration of the mounting bracket or compressed gas system in order to operate the paintball gun with the opposing hand;

e) to provide a mounting bracket which allows for the compressed gas system of a paintball gun system to be positioned in such a way that the vertical profile of the paintball gun system is reduced, and that does not require a reconfiguration of the mounting bracket or compressed gas system in order to achieve this effect;

f) to provide a mounting bracket which allows for all of the previously outlined objects and advantages to be employed simultaneously and without reconfiguration of any element of the paintball gun system.

Still further objects and advantages will become apparent from a consideration of the ensuing description and drawings.

SUMMARY OF THE INVENTION

The present invention, accordingly, is directed toward a mounting bracket used to attach a compressed gas system to a lower side surface of a paintball gun. The mounting bracket positions the compressed gas system in relation to the paintball gun such that it lowers the vertical profile of the paintball gun system with respect to the user's body, shortens the overall length of the paintball gun system with respect to the user's body, and prevents the compressed gas system from obstructing the user's arm when grasping the paintball gun. The mounting bracket positions the tank such that a considerable portion of the paintball gun system's weight is borne by the user's shoulder, and improves the stability of the paintball gun system so that the user may more steadily operate the paintball gun system while s/he is in motion.

DRAWINGS—REFERENCE NUMERALS

10—a paintball gun system depicting the preferred embodiment
11—a paintball gun
12—a compressed gas system
13—mounting bracket of the preferred embodiment
14—a rear surface of a paintball gun
15—a conduit for supplying compressed gas to a paintball gun
16—a gas fitting

17—a compressed gas cylinder
18—a compressed gas valve
19—a paintball gun system depicting prior art
20—a prior art mounting bracket from the public domain
21—butt end of a compressed gas cylinder
22—paintball gun trigger frame
23—foregrip
24—a paintball loading mechanism
25—a paintball gun system depicting prior art
26—a "rail mount"
27—a fulcrum point of the preferred embodiment on the body of a user
28—the mating surface of a compressed gas system
29—fulcrum point used by prior art paintball gun systems
30—paintball gun's feed tube
31—mounting hardware
32—mounting holes of mounting bracket 13
33—dovetail joint (male) of mounting bracket 13
34—dovetail joint (female) of compressed gas system 12

DETAILED DESCRIPTION OF THE PREFERRED EMBODIMENT

Figure 1A:
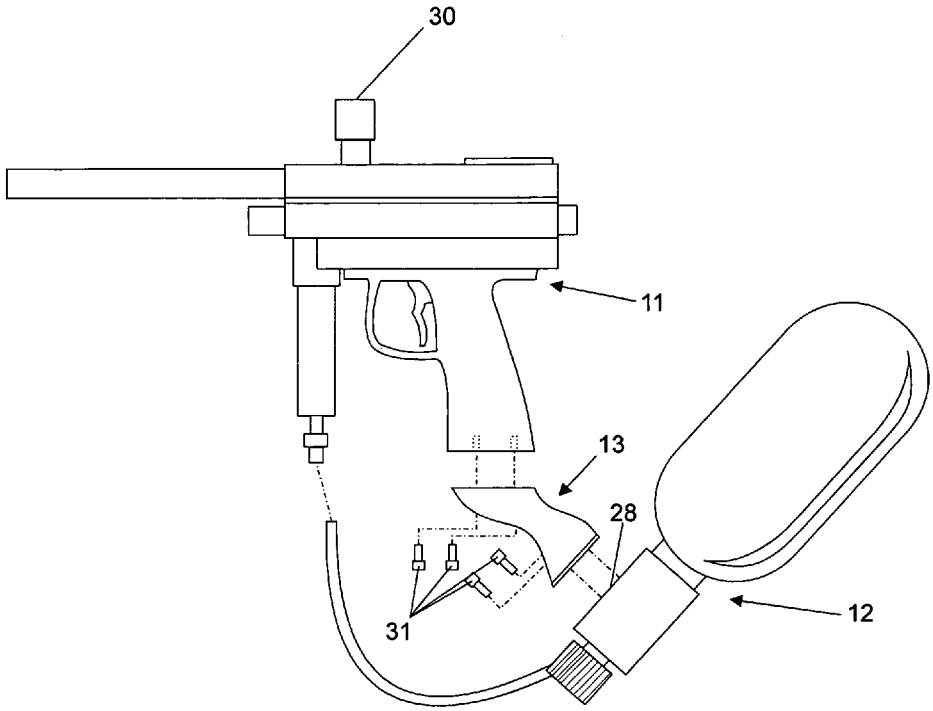
FIG. 1A is a side view of the preferred embodiment of a device for securing a compressed gas system to a paintball gun in its disassembled orientation.
Figure 1C:
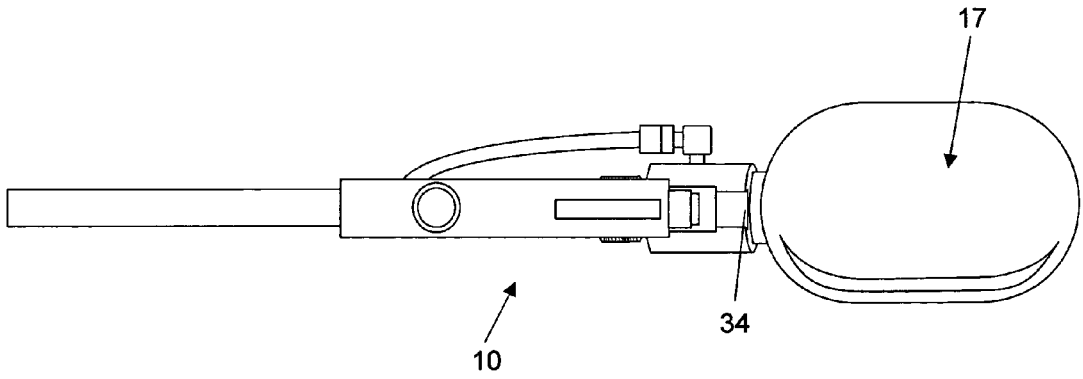
FIG. 1C is a top view of the configuration described in FIG. 1B.
Figure 1B:
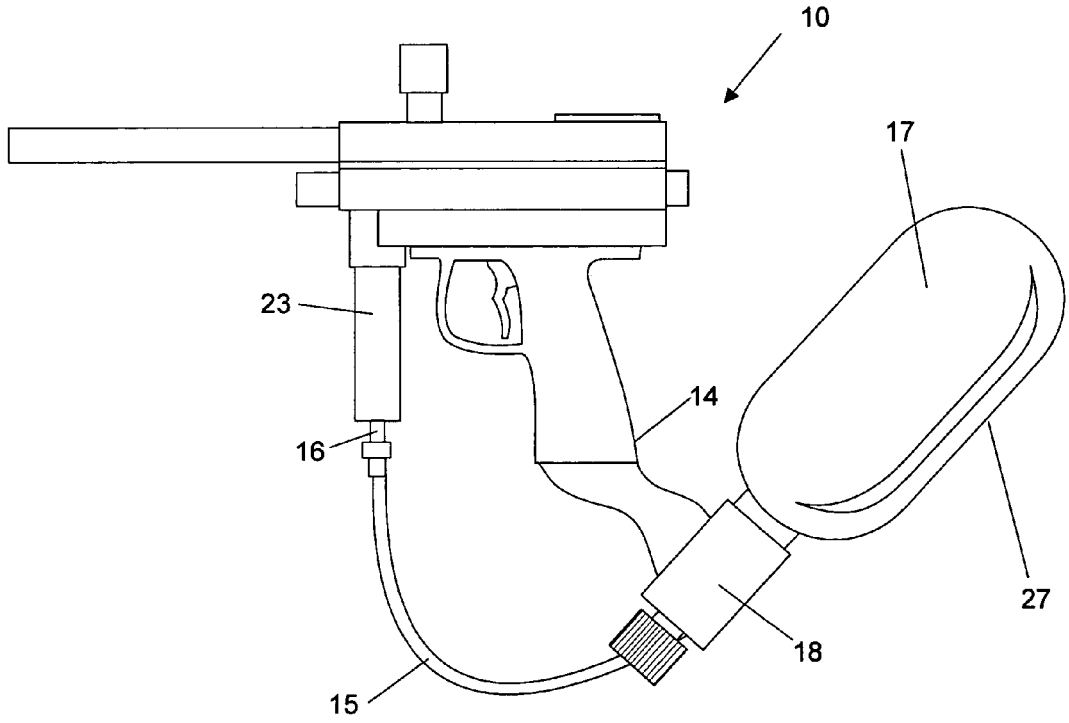
FIG. 1B is a side view of the preferred embodiment of a device for securing a compressed gas system to a paintball gun secured to the compressed gas system and to the paintball gun.
Figure 5:
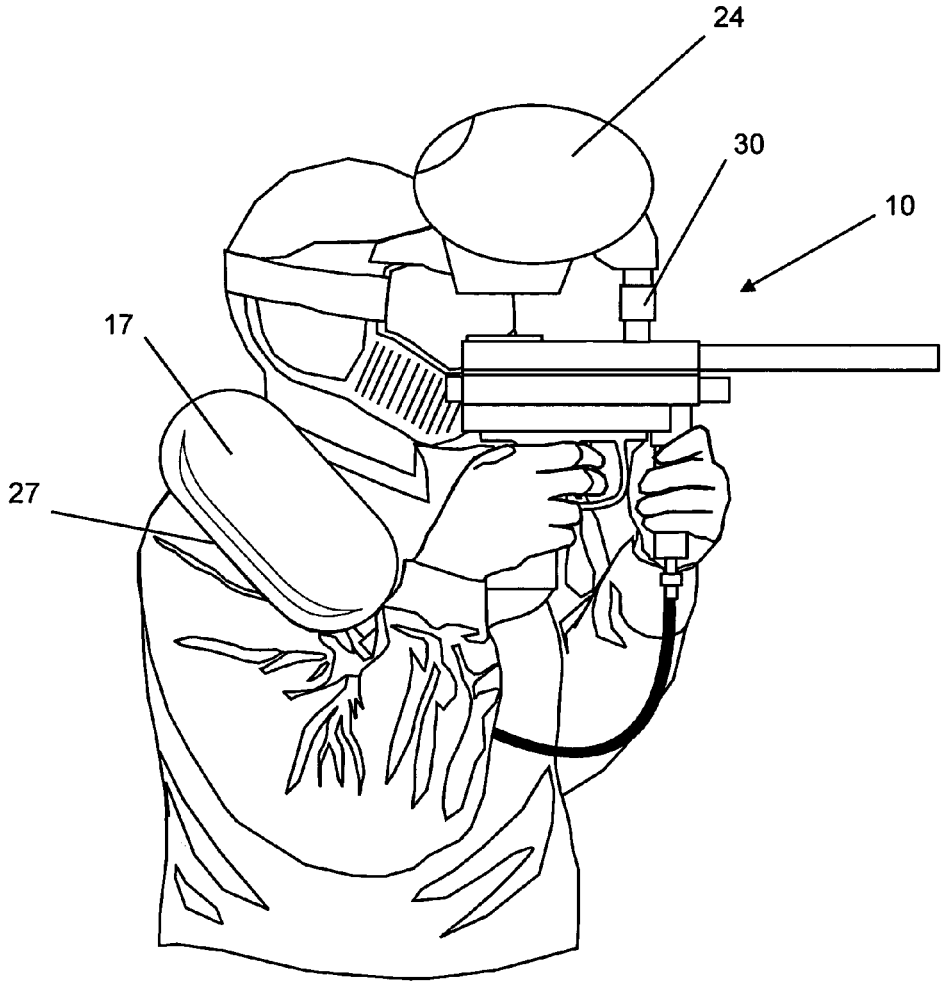
FIG. 5 is a drawing of the preferred embodiment of the invention, as it would be used by a player of the game of paintball.
Figure 6:
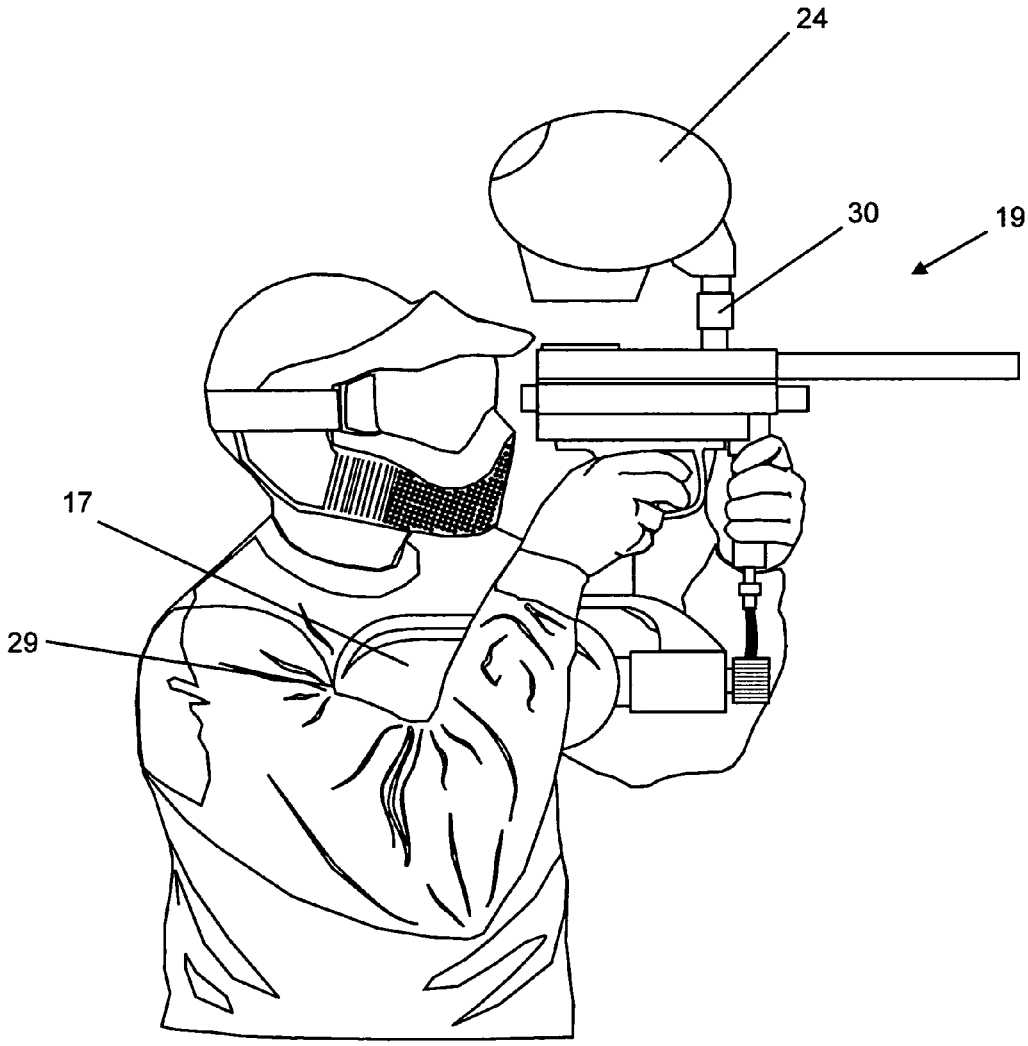
Fig. 6 Prior Art
FIG. 6 is a drawing of the prior art depicted in FIGS. 2A and 2B, as it would be used by a player of the game of paintball.
Figure 7:
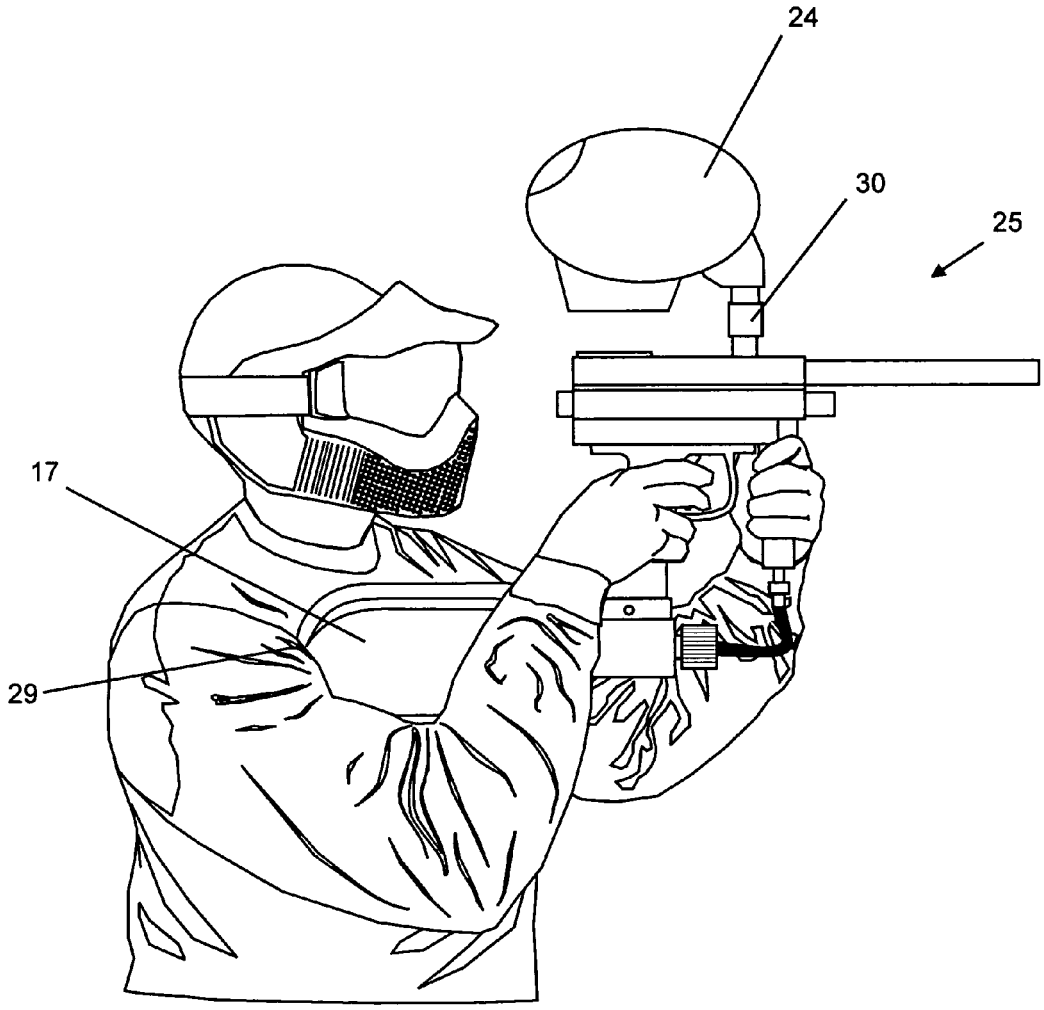
Fig. 7 Prior Art
FIG. 7 is a drawing of the prior art depicted in FIGS. 3A and 3B, as it would be used by a player of the game of paintball.

Referring first to FIGS. 1A–C, a paintball gun system 10 comprising a paintball gun 11, a compressed gas system 12, and a mounting bracket 13 which attaches the compressed gas system 12 to the paintball gun 11 in such a way that the compressed gas system 12 is positioned behind a rear surface 14 of the paintball gun 11 and at an angle to the paintball gun's horizontal axis. The compressed gas system 12 supplies the pressurized propellant to the paintball gun 11 by means of a conduit 15 mated to a fitting 16 attached to the paintball gun. FIGS. 5, 6 and 7 also depict a paintball loader 24, in addition to the previously mentioned elements of the paintball gun system, which attaches to the paintball gun via a feed tube 30. Since the focus of the present invention is the mounting bracket 13, the paintball loader 24 is omitted from FIGS. 1A–C, 2A–B and 3A–B to simplify those drawings.

The compressed gas system 12 is typically comprised of the following parts: a gas cylinder 17, and a valve 18 that may be of a pressure-regulated or unregulated variety. Generally speaking, the gas cylinder 17 is the most cumbersome and awkward component of a paintball gun system 10 and its orientation with respect to the paintball gun has seen many attempts to mitigate its awkwardness. The shortcomings of prior art will be examined before describing, in depth, the preferred embodiment of the invention contained herein.

Figure 2B:
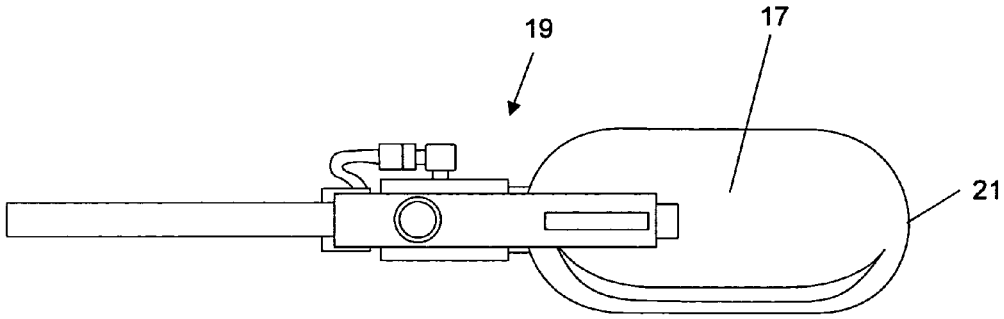
Fig. 2B Prior Art
FIGS. 2A and 2B respectively show side and top views of an example of a prior art paintball gun employing a mounting bracket that places the mating surface of the compressed gas system below and ahead of the lower side mounting surface of the paintball gun.
Figure 2A:
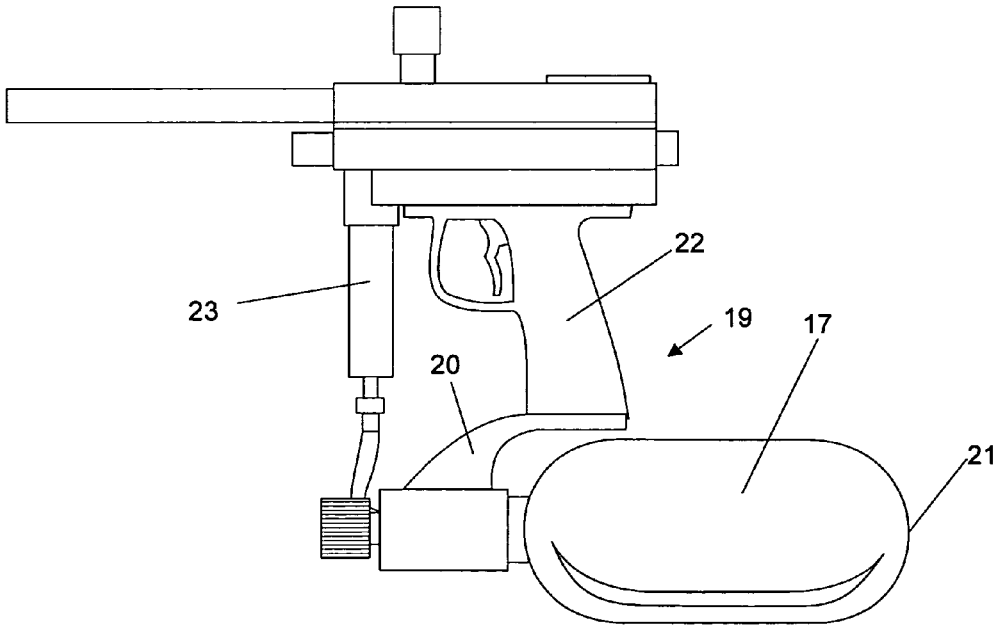
Fig. 2A Prior Art

FIGS. 2A and 2B respectively depict side and top views of a paintball gun setup 19 that uses a mounting bracket commonly referred to as a "drop forward" 20. In this configuration, a user generally places the butt-end 21 of the compressed gas cylinder 17 against the front side of the user's shoulder, which acts as a fulcrum 29, grasps the trigger frame 22 in a manner such that the user's forearm is approximately vertical with respect to the paintball gun setup 19 and whose elbow is below the compressed gas cylinder 17, and usually grasps a forward structure of the gun such as a foregrip 23 with the other hand. By comparing FIGS. 2A and 2B, and referencing FIG. 6 it is possible to see that based upon the preceding description, the user must reach around the compressed gas cylinder 17 in order to grasp the trigger frame 22. This pushes the elbow outward from the body, which increases the lateral profile of the player making it easier for an opponent to eliminate him or her from play. This position is also a rather uncomfortable way to manipulate this paintball gun setup 19, and it increases the vertical profile of the paintball gun setup 19 so that the paintball loader 24 sticks well above the user's head. In the game of paintball, it is common for a player to be hiding behind a piece of hard cover or "bunker" that is shorter than the player is. This gives the player the opportunity to play along the top edge of the bunker by quickly standing up, and shooting at the intended target before ducking back under cover. However, since this paintball gun setup 19 places the paintball loader 24 far above the player's head, it enables the opponent to see the player's paintball loader 24 before the player can see the opponent. This is a distinct disadvantage for the player, and a prime target of opportunity for the opponent.

Figure 3B:
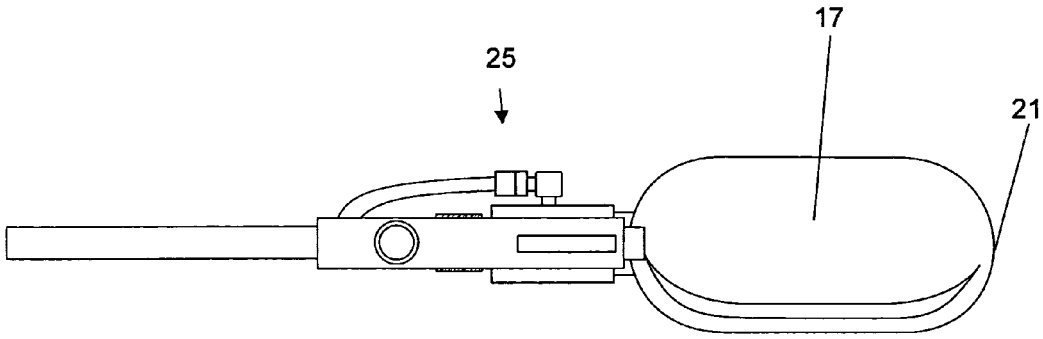
Fig. 3B Prior Art
FIGS. 3A and 3B respectively show side and top views of an example of a prior art paintball gun employing a mounting bracket that places the mating surface of the compressed gas system directly below the lower side mounting surface of the paintball gun.
Figure 3A:
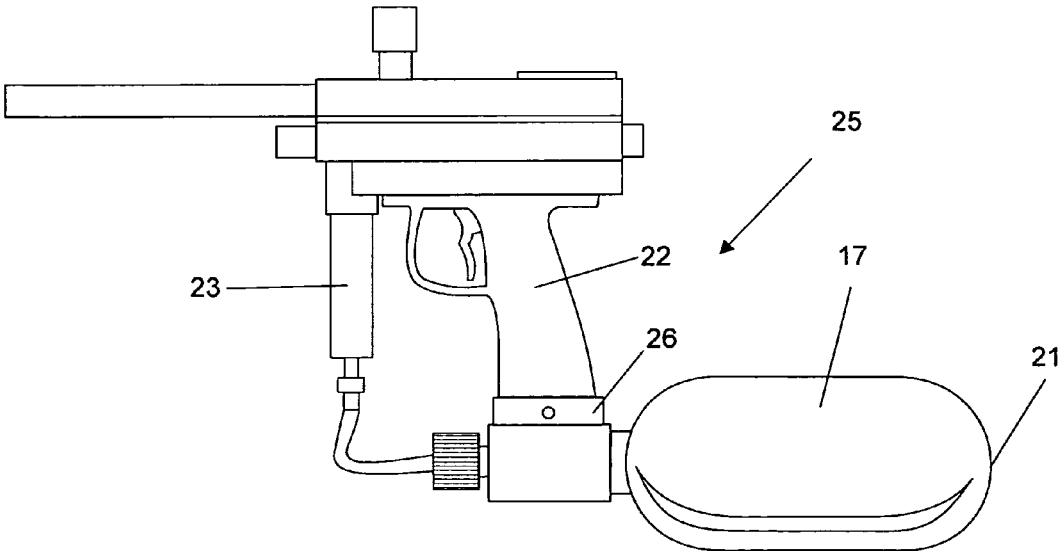
Fig. 3A Prior Art

FIGS. 3A and 3B respectively depict side and top views of a paintball gun setup 25 that generally places the mating surface 28 (FIG. 1A) of the compressed gas system 12 immediately below the bottom of the trigger frame 22. The mounting hardware and mounting brackets used are widely varied for achieving this result due to the different types of compressed gas systems available, but FIGS. 3A and 3B depict a mounting bracket commonly referred to as a "rail mount" 26. In this configuration, a user generally places the butt-end 21 of the compressed gas cylinder 17 against the front side of the user's shoulder, which acts as a fulcrum 29, grasps the trigger frame 22 in a manner such that the user's forearm is approximately vertical with respect to the paintball gun setup 25 and whose elbow is below the compressed gas cylinder 17, and usually grasps a forward structure of the gun such as a foregrip 23 with the other hand. By comparing FIGS. 3A and 3B, it is possible to see that based upon the preceding description, that the forearm obstruction encountered by the setup depicted in FIGS. 2A and 2B is somewhat mitigated, and the vertical profile of the paintball gun setup 25 relative to the user is not as pronounced in FIG. 3A as it is in FIG. 2A. However, the total, horizontal length of paintball gun setup 25 is longer than the total, horizontal length of paintball gun setup 19 so, the advantage of a reduced horizontal profile employed in paintball gun setup 19 is not achieved with paintball gun setup 25 (see FIG. 8).

Referring back to FIGS. 1B and 1C, the fulcrum point 26 mentioned when describing the operation of paintball gun setups 19 and 25 (FIGS. 6 and 7, respectively) differs from the paintball gun system 10 in that its fulcrum point 27 is approximately at the top surface of the user's shoulder (see FIG. 6). This different fulcrum point 27 is key to some of the advantages offered by the present invention. In nearly every other paintball gun system, both patented and in the public domain, steadying those paintball gun systems requires holding the paintball gun system aloft with one or more hands, in a manner previously described, while forcibly pulling the butt-end 21 of the compressed gas cylinder 17 into the front of the shoulder (see FIGS. 6 and 7) to limit the range of free motion of the paintball gun system. The fulcrum point 27 of the present invention allows the compressed gas cylinder 17 to rest on top of the user's shoulder, which transfers a portion of the weight of the paintball gun system 10 to the upper body of the user, relieving a portion of the burden on the user's arms. This new fulcrum point 27 also shortens the horizontal profile of the paintball gun system relative to the user's body. (Compare FIG. 5 to FIG. 6 and FIG. 7) Since the compressed gas cylinder 17 is tilted at an angle that extends it downward from the fulcrum point 27, the mating surface 28 of the compressed gas system 12 is lowered below the fulcrum point 27 so that the vertical profile of the paintball gun system is thereby reduced, relative to the user's body.

Figure 4:
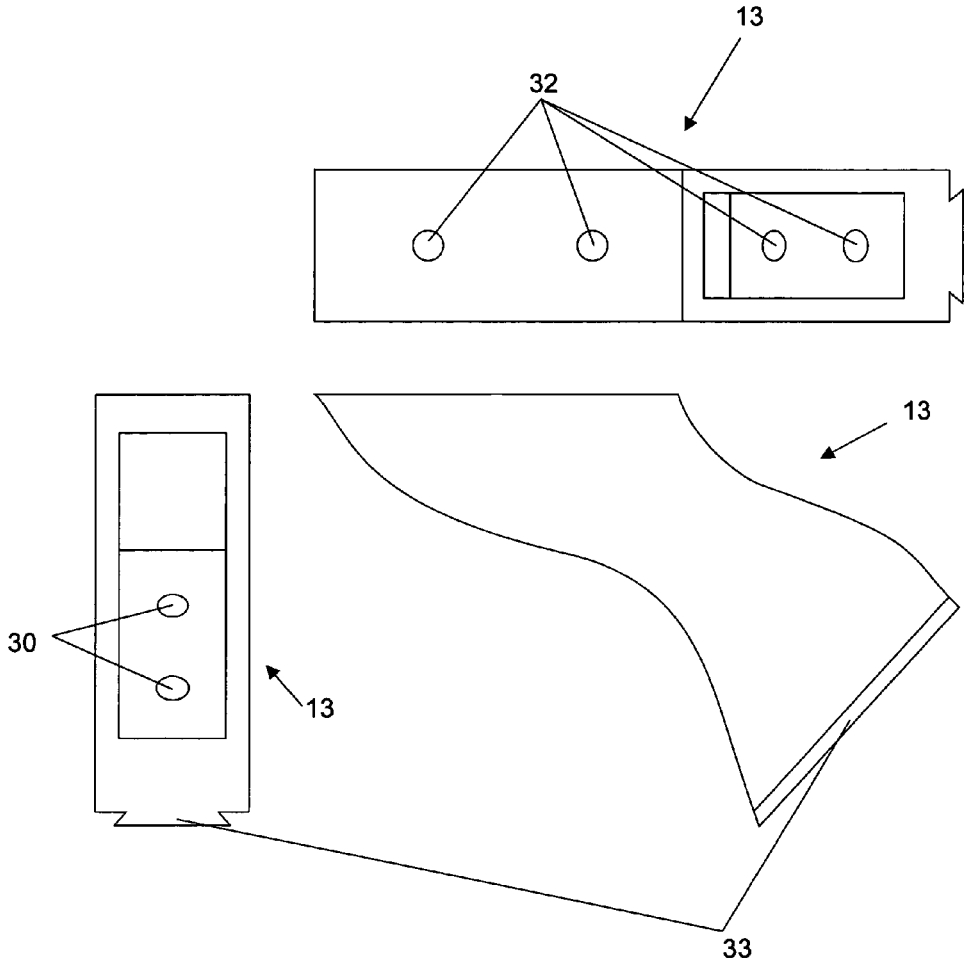

FIG. 4 shows a plan view drawing of a preferred embodiment of the mounting bracket 13 of the present invention. This drawing is provided to show the mounting holes 32 and dovetail joint 33 of the mounting bracket 13 used to attach the paintball gun 11, mounting bracket 13, and compressed gas system 12 together with the previously depicted mounting hardware 31 shown in FIG. 1A. The dovetail joint 33 is a common structure used to attach prior art mounting brackets to compressed gas systems, and may be employed by the present invention. The complementary structure 34 of the dovetail joint 33 on the mounting bracket 13 is shown in FIG. 1C.

While this invention has been described fully and in some instances in specific detail, it should be understood that the preferred embodiment described is presented as an illustrative example and that there are numerous modifications, changes and variations that may be practiced otherwise within the scope of the appended claims. In particular, the degree to which the compressed gas system is tilted, or positioned with respect to a paintball gun can vary to suit the body types of players of different sizes and ages. Accordingly, it is appropriate that the appended claims be construed broadly and in a manner consistent with the scope of the invention.

I claim:

1. A device for securing a compressed gas system to a paintball gun, having a lower mating surface, comprising:

a bracket, said bracket being structured to provide a means of positioning for said compressed gas system to said lower mating surface of said paintball gun such that the butt end of said compressed gas system is tilted at an upward angle relative to said lower mating surface of said paintball gun and positioned rearward of said mating surface of said paintball gun.

2. A bracket as recited in claim 1 wherein said means of positioning of said compressed gas system provides a means of placement of said compressed gas system on a shoulder of a user thereby transferring a substantial portion of the weight of said paintball gun system to said shoulder of said user.

3. A bracket as recited in claim 1 wherein said means of positioning of said compressed gas system provides a means of placement of said compressed gas system on a shoulder of said user thereby shortening the effective length of said paintball gun system.

4. A bracket as recited in claim 1 wherein said means of positioning of said compressed gas system allows the user to hold, aim, or fire said paintball gun without said compressed gas system obstructing the arm, hand, and/or wrist of said user.

5. A device for securing a compressed gas system to a paintball gun as recited in claim 1 wherein said means of positioning of said paintball gun reduces the effective vertical profile of the paintball gun, relative to said user.

6. A paintball gun system comprising:

a paintball ejection system, having a lower mating surface; and a compressed gas system, having a mating surface, used to propel paintballs from said paintball gun; and a bracket, providing a means of positioning said compressed gas system to said paintball gun such that the butt end of said compressed gas system is tilted at an upward angle relative to said mating surface of said paintball gun and positioned behind said mating surface of said paintball gun.

7. A paintball gun system as recited in claim 6 wherein said means of positioning provides for the placement of said compressed gas system on a shoulder of a user such that a substantial portion of the weight of said paintball gun system is transferred to said shoulder of said user.

8. A paintball gun system as recited in claim 6 wherein said means of positioning provides a means of placement of said compressed gas system on a shoulder of a user such that the length of said paintball gun system, relative to a user's body, is reduced.

9. A paintball gun system as recited in claim 8 wherein said means of positioning and said means of placement of said paintball gun system moves the center of mass of said paintball gun system closer to said user.

10. A paintball gun system as recited in claim 9 wherein said paintball gun system has a vertical profile and wherein said means of positioning and said means of placement reduces said vertical profile of said paintball gun system, relative to a user's body.

* * * * *